United States Patent [19]

Small

[11] Patent Number: 4,800,864

[45] Date of Patent: Jan. 31, 1989

[54] REPEATING RUBBER BAND PROJECTING GUN

[76] Inventor: Steve E. Small, 5811 E. Waverly, Tucson, Ariz. 85712

[21] Appl. No.: 100,207

[22] Filed: Sep. 23, 1987

[51] Int. Cl.[4] ..... F41B 7/02

[52] U.S. Cl. ..... 124/19; 124/35 R; 124/48

[58] Field of Search ..... 124/18, 19, 35, 41 R, 124/48; 74/142

[56] References Cited

U.S. PATENT DOCUMENTS

| | | | |
|---|---|---|---|
| 2,550,873 | 5/1951 | Siders | 124/19 |
| 2,741,238 | 4/1956 | Arnold | 124/19 |
| 2,917,037 | 12/1959 | Henderson | 124/19 |
| 3,515,387 | 6/1970 | House | 273/101 |
| 3,693,609 | 9/1972 | Vodinh | 124/19 |
| 3,757,760 | 9/1973 | Darnell | 124/19 |
| 4,676,219 | 6/1987 | Miller | 124/19 |

*Primary Examiner*—Randolph A. Reese
*Assistant Examiner*—John A. Ricci

[57] ABSTRACT

A toy gun for shooting rubber bands in rapid succession includes a rotating cylinder onto which the rubber bands initially are loaded one-by-one. Rotation of the cylinder to effectuate initial loading of the rubber bands stretches an elastic cord which later rotates the cylinder in the opposite direction as rubber bands are fired in succession. A plurality of pivotal hooks disposed on the rear portion of the rotating cylinder each engage the rear end of a stretched rubber band, the forward end of which is retained by a corresponding hook disposed on the front portion of the cylinder. An actuator/stop element responsive to a trigger operates to depress or pivot the hook and rubber band aligned with the actuator/stop element, shooting that rubber band. The depressed or pivoted hook is retained so that when the trigger is released, the actuator/stop element moves away from a rotation limiting stop connected to the depressed or pivoted hook. The pre-tensioned elastic cord rotates the cylinder to align the next rubber band with the actuator/stop element. A rotation limiting stop connected to the next hook abuts the actuator/stop element, at which time the trigger is to be pulled again to fire the next rubber band.

9 Claims, 2 Drawing Sheets

FIG. 6A
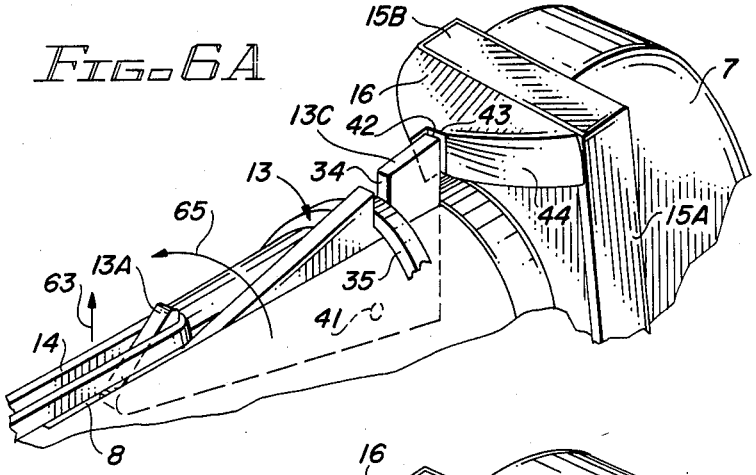
FIG. 6B
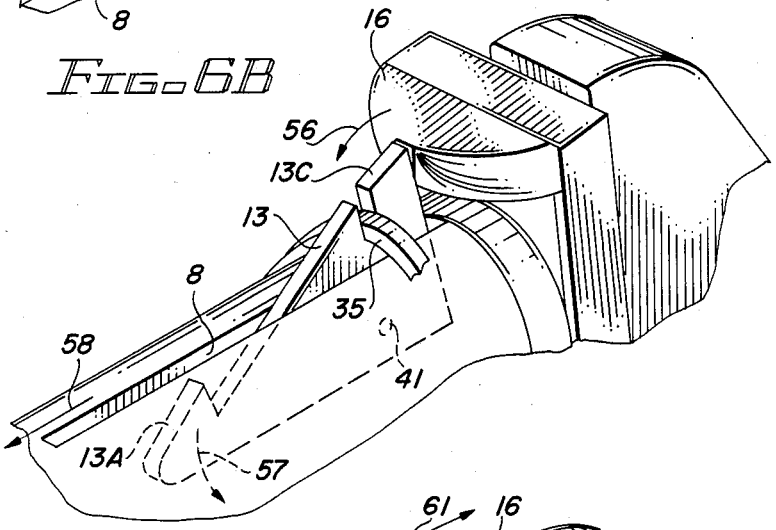
FIG. 6C
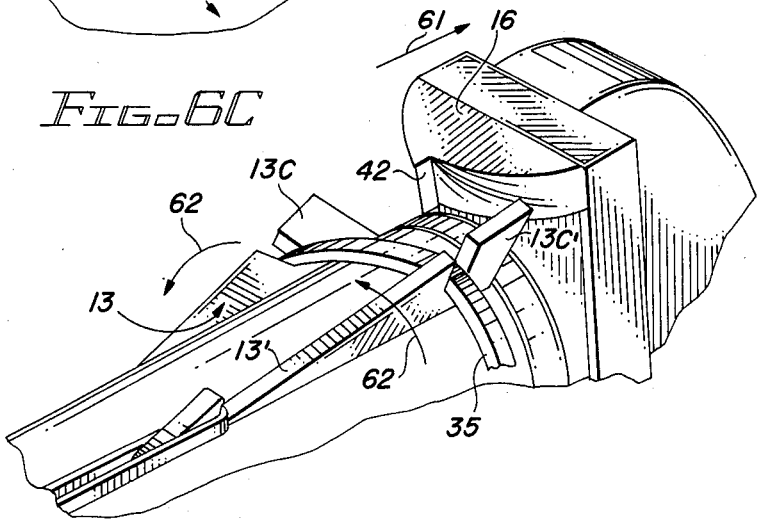
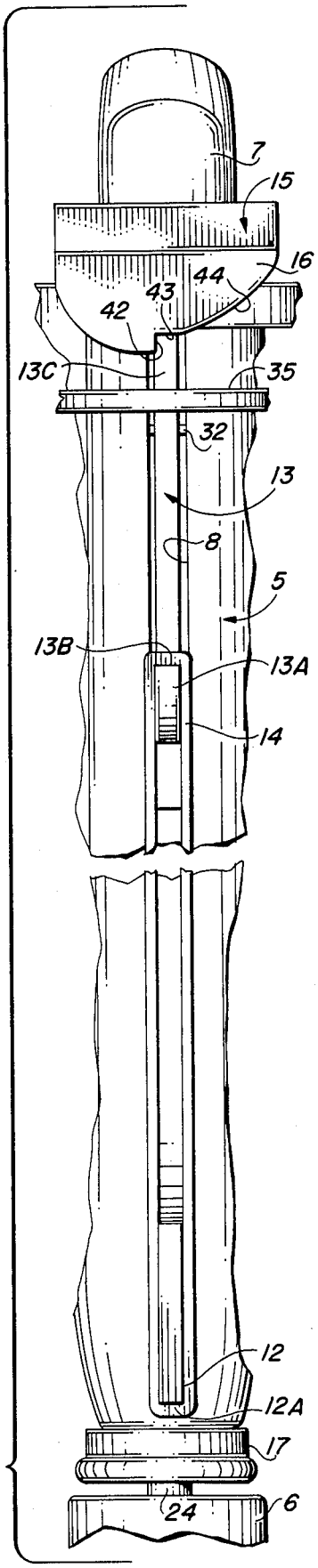
FIG. 7

REPEATING RUBBER BAND PROJECTING GUN

BACKGROUND OF THE INVENTION

The invention relates to toy guns of the repeating type for shooting rubber bands, and more particularly to such toy gun that can accurately fire rubber bands as fast as a user can pull and release the trigger.

Quite a variety of rubber band repeating guns for rapidly discharging rubber bands have been proposed. U.S. Pat. Nos. 3,757,760, 3,693,609, 3,515,387, and 2,917,037 are generally indicative of the state-of-the-art. The first two above-mentioned patents have the ability to discharge rubber bands in a repeating fashion. They use a double action mechanism with a rotating barrel to accomplish both the releasing of a rubber band and rotation of the barrel to a next firing position. This process begins when the trigger is pulled. A cam or rod moves up and pushes the rubber band off the stationary catch. Upon release of the trigger, the same mechanism operates to rotate the revolving barrel to the next firing position. The release of the rubber band utilizes a cam or lever that pushes the rubber band off of its stationary hook, distorting the alignment of the rubber band and impairing the shooting accuracy.

SUMMARY OF THE INVENTION

Accordingly, it is an object of the invention to provide a repeating type of toy gun for discharging rubber bands more rapidly and more accurately than has been possible with prior toy guns.

It is another object of the invention to provide such a toy gun with a less complicated, less expensive mechanism than has been used in prior repeating-type toy rubber band shooting guns.

Briefly described, and in accordance with one embodiment thereof, the invention provides a toy gun for repetitively firing a plurality of stretched rubber bands, the toy gun including a rotary cylinder with front hooks over which a front ends of stretched rubber bands are looped to load the gun. Each of a plurality of rear hooks are attached to a respective arm that is pivotally connected to a rear portion of the rotary cylinder. The rear end of each stretched rubber band is looped over a rear hook. Tension in the rubber band retains the rear hook in a first position. Each of a plurality of rotation limiting stops are connected by a corresponding arm to a pivotal rear hook. Each rotation limiting stop can engage an actuator/stop element to index a rear hook with the actuator/stop element. During loading of the rubber bands onto the rotary cylinder, it is rotated against an elastic element that urges the cylinder to rotate in the opposite direction. The elastic element later rotates the cylinder as loaded rubber bands are successively fired. Pulling a trigger of the toy gun moves the actuator/stop element to pivot a first of the rear hooks that is aligned with the actuator/stop element from its first position to a second position. This releases the corresponding stretched rubber band, thereby firing it. The first hook then is retained in its second position, and the corresponding rotation limiting tab is retained in a corresponding position. Releasing of the trigger then causes withdrawal of the actuator/stop element from the first rotation limiting stop. This allows the cylinder to rotate until a second rotation limiting stop engages the actuator/stop element, aligning a second rear hook with the actuator/stop element. A second rubber band then can be fired by again pulling the trigger. The mechanism allows loaded rubber bands to be fired as fast as a user can pull and release the trigger.

BRIEF DESCRIPTION OF THE DRAWINGS

FIGS. 6A–6C show a sequence of partial perspective views of the firing mechanism during a firing sequence.

FIG. 7 is a partial top view of the toy gun shown in FIG. 1.

DETAILED DESCRIPTION OF THE PREFERRED EMBODIMENT

Figures 1, 2, 3, 4, 5:
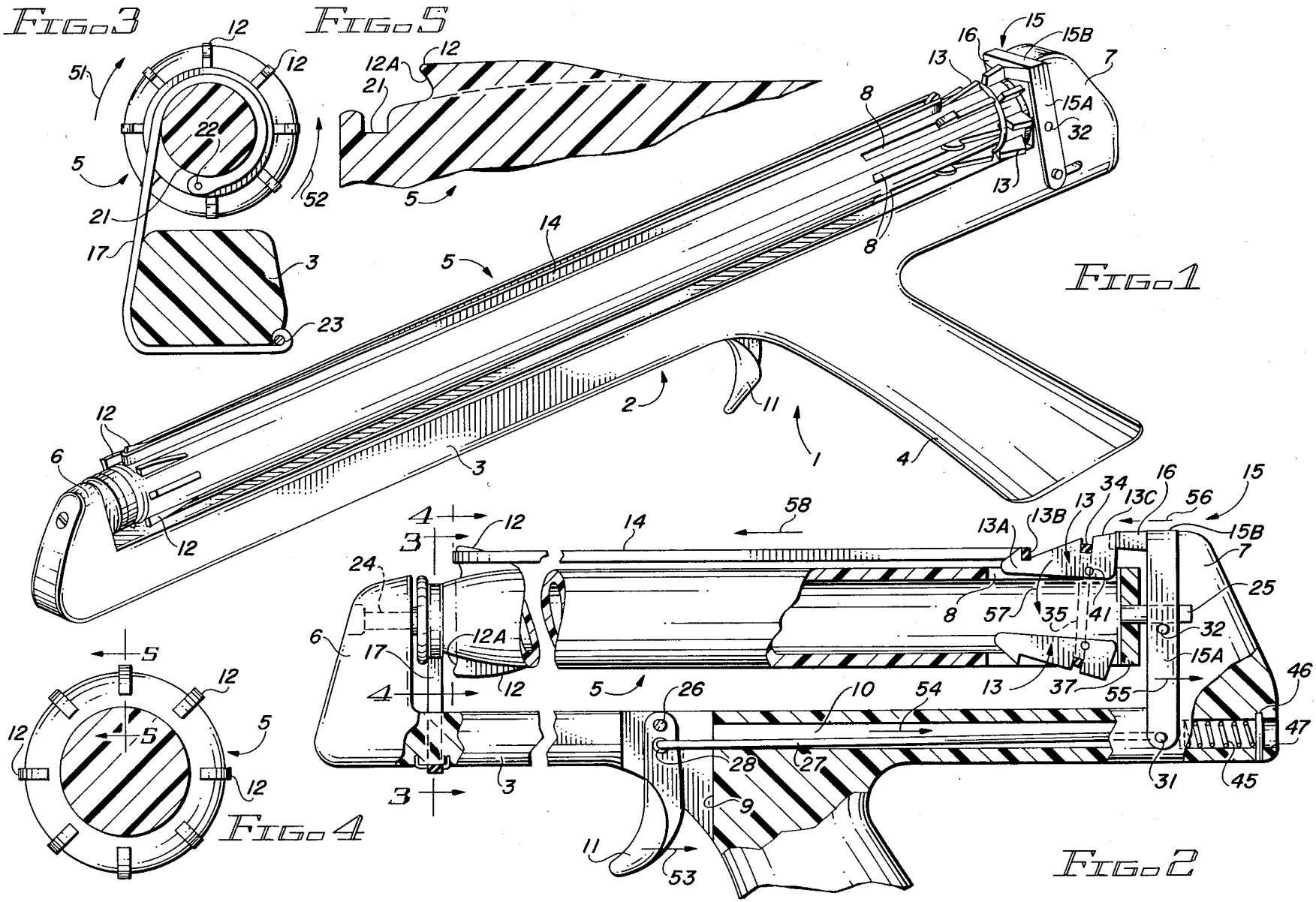
FIG. 1 is a perspective view of my repeating rubber band gun, with one rubber band loaded.
FIG. 2 is a partial cutaway elevational view of the toy gun of FIG. 1.
FIG. 3 is a section view taken along section line 3—3 of FIG. 2.
FIG. 4 is a section view taken along section line 4—4 of FIG. 2.
FIG. 5 is a section view taken along section 5—5 of FIG. 4.

Referring now to the drawings, toy gun 1 includes a frame 2 including an elongated member 3 with an integral pistol grip handle 4 attached to its rear lower section. A front support 6 and a rear support 7 extend upward from the front and rear ends of member 3. Opposite ends of a rotating barrel 5 are journalled between supports 6 and 7 by means of pins 24 and 25, as best shown in FIG. 2.

Barrel 5 includes eight equally spaced stationary hooks 12 disposed around the front end of barrel 5. Each hook 12 protrudes radially outwardly from barrel 12 and has a forwardly sloped portion that catches the front end of a rubber band, such as rubber band 14.

Eight equally spaced pivotal hooks 13 are disposed in radially oriented elongated grooves 8 in the rear portion of barrel 5. Each of eight rubber bands such as 14 has its rear portion retained by portion 13A of each pivoting hook 13.

In accordance with the present invention, a linkage between a trigger 11 and a firing mechanism 15 causes the pivot hooks 13 to release one of the rubber bands loaded on barrel 5 and also allows barrel 5 to rapidly rotate to bring the next loaded rubber band and the next pivot hook 13 engaging that rubber band into proper registry with the firing mechanism 15.

The configuration of the stationary hooks 12 is best shown in FIG. 5, wherein forwardly sloped forward surface 12A that engages the front end of a stretched rubber band is shown. A continuous groove 21 forms a pulley in the front portion of barrel 5 in which a rubber band 17 is permanently attached by means of a pin 22. A second pin 23 fastens a second end of elastic band 17 in fixed relationship to member 3.

As a user "loads" barrel 5 with eight rubber bands, one-by-one, the user has to rotate barrel 5 in the direction of arrow 51 in FIG. 3, thereby tightening elastic band 17. During the firing sequence subsequently explained, elastic band 17 causes step wise rotation of barrel 5 in the direction of arrow 52, automatically bringing the next rubber band to be fired into registry with the firing mechanism 15. (It should be noted that other techniques for "spring biasing" barrel 5 could be provided, for example by providing a coil spring having one end anchored within barrel 5 and another end anchored with respect to boss 6.)

The firing mechanism 15 perhaps can be best described with reference to FIG. 2. The lower portion of trigger 11 extends downward from member 6 through a slot 9. The upper end of trigger 11 is pivotally connected by pivot pin 26 to member 3. A horizontal push rod 27 contained within a channel 10 through member 3 has its left end pivotally connected at through hole 28 in trigger 11 to a point spaced below pivot pin 26. The right end of push rod 27 is pivotally connected at 31 to the lower end of an arm 15A of firing mechanism 15.

Firing mechanism 15 includes an inverted U-shaped member including two vertical arms 15A and a horizontal top member 15B. A ratchet element 16 is attached to the top member 15B. Ratchet stop 16 can be best seen in FIGS. 6A and 7, and includes a sloped, gently curved surface 44 that is inclined relative to the vertical plane of the U-shaped firing mechanism 15. A forward portion of ratchet stop 16 includes a stop or shoulder 42 that lies in a vertical plane aligned with the axis of barrel 5. A vertical surface 43 perpendicular to shoulder 32 acts as a "firing pin" surface that forces the upper rear portion of a pivotal hook 13 forward when vertical arms 15A pivot forward in the direction of arrow 56 of FIG. 6B.

Except when trigger 11 is pulled, a spring 45 disposed in bore 47 urges the lower portion of vertical arms 15A of firing assembly 15 forward. A stop 46 resists the compressive force of spring 45.

Each pivotal hook 13 includes a forward hook portion 13A having a rearwardly sloped surface 13B (FIG. 2) around which the rear end of a rubber band 14 is hooked. Each pivotal hook 13 also includes a rear enlarged portion 13C having a rear edge which abuts and is pushed forward by above-mentioned firing pin surface 43 to "fire" rubber band 14. Each pivotal hook 13 is pivotally connected by a pin 41 that extends between opposite faces of a slot 8. Each of the pivotal hooks 13 thus can pivot within its respective slot 8 so that its forward hook portion 13A can be raised to extend beyond the outer surface of barrel 5, or can recede into that slot 8.

Disk 37 attached to the rear end of barrel 5 has a centered hole therein through which pin 25 extends, allowing barrel 5 to rotate along its longitudinal axis, supported in bosses or support posts 6 and 7.

In operation, the first step is to "load" eight rubber bands onto rotating barrel 5. To accomplish this, the user rotates barrel 5 in the direction of arrow 51 (FIG. 3) enough to produce tension in elastic band 17. The user then loops one end of the rubber bands around the forward edge 12A of one of the uppermost stationary hooks 12, depresses the upper rear edge of the corresponding pivotal hook 13 to cause the hook portion 13A thereof to extend outward from corresponding slot 8. The user then slips the rear portion of the stretched rubber band around that hook. This prevents the hook portion 13A from receding into its slot 8.

The user then rotates barrel 5 further in the direction of arrow 51 to position the next stationary hook 12 and its corresponding pivotal hook 13 in a convenient location for installing another rubber band thereon. This process is repeated until barrel 5 has been rotated nearly 360° degrees to expose allow loading of all eight rubber bands on barrel 5. The toy gun then is ready to fire.

The first rubber band to be fired then is as indicated in FIG. 6A. The fact that the hook portion 13C of the top pivotal hook 13 is raised above the edges of slot 8 causes its rear portion 13C to pivot rearward. The tension of elastic band 17 urges barrel 5 and pivoting hook 13 in FIG. 6A in the direction of arrow 65 (FIG. 6A), forcing the rear portion of rear section 13C against stop surface 42.

The user then "fires" the toy gun by pulling trigger 11 in the direction of arrow 53 (FIG. 2). This causes push rod 27 to move in the direction of arrow 54, causing the lower portion of vertical arms 15A to pivot rearward in the direction of arrow 55. This causes the upper portion of firing arm 15A to which ratchet element 16 is attached to pivot forward in the direction of arrow 56.

This forces portion 13C forward, as indicated by arrow 56 in FIG. 6B. This pivoting causes the hook portion 13A to move downward into slot 8, as indicated by arrow 57, thereby causing the rear end of rubber band 14 to "peel off" of hook section 13A. The rapid contraction of rubber band 14 then causes it to be propelled forward toward its target in the direction of arrow 58 in FIG. 6B.

When the user then releases trigger 11, the compressive force of spring 45 (FIG. 2) causes trigger 11, push rod 27, the upper end of firing mechanism 15, and ratchet element 16 to move in the directions opposite to arrows 53, 54, and 56, respectively. More specifically, it causes ratchet element 16 to move rearward in the direction of arrow 61, as indicated in FIG. 6C. Elastic band 35, which fits into grooves 34 of each of the eight pivoting hooks, slightly forward of the location of pivot pins 41, urges all of the hook portions 13A of the pivoting hooks 13 to recede into the respectively elongated slots 8. The force produced by elastic band 35 retains hook portion 13A of the present pivotal hook 13 within its corresponding slot 8. Therefore, when ratchet element 16 moves away from section 13C, stop surface 42 no longer prevents barrel 5 from rotating. The torque applied to barrel 5 by elastic band 17 now rotates it in the direction of arrows 62 in FIG. 6C until the next rear section 13C' of the pivotal hook 13' retaining the next rubber band strikes stop surface 42. The gun is then ready to be fired again.

The above-described toy gun thus provides a relatively simple firing mechanism that allows the user to shoot rubber bands as fast as he or she can pull the trigger. This gun provides a significant improvement over prior art rubber band shooting guns by eliminating all levers, cams, springs, push rods, etc. normally needed to rotate the barrel in response to pulling of the trigger. As a result, the rotating barrel is essentially "self-powered", and trigger tension is substantially reduced. The firing speed is greatly increased over prior rubber band shooters. Because of the reduction in the number of the parts and the simplicity of the design, the cost of producing the above-described toy gun will be less than for the prior art. The toy gun is as accurate as it is possible to make a rubber band shooter because the method of releasing the rubber bands does not distort the alignment of the rubber bands at all, as is the case with some of the prior art devices.

While the invention has been described with reference to a particular embodiment thereof, those skilled in the art will be able to make various modifications to the described embodiment of the invention without departing from the true spirit and scope thereof. It is intended that all elements and steps which perform substantially the same function in substantially the same manner to achieve the same result are within the scope of the invention.

I claim:

1. A toy gun for repetitively firing a plurality of stretched rubber bands, comprising in combination:

(a) a rotary cylinder with a plurality of front hooks retaining front ends of the rubber bands;

(b) means for continuously urging the cylinder to rotate in a first direction;

(c) a plurality of means connected to the cylinder in alignment with the front hooks, respectively, for retaining rear ends of the rubber bands;

(d) a plurality of means respectively connected to the retaining means for releasing rear ends of the rubber bands;

(e) a trigger;

(f) means disposed in fixed relationship to an axis of rotation of the cylinder for selectively actuating the various releasing means in response to pulling of the trigger to thereby release the rubber bands;

(g) a plurality of rotation limiting means connected to the respective releasing means for (1) engaging the actuating means to stop rotation of the cylinder at a first position at which one of the releasing means is aligned with the actuating means and (2) disengaging the actuating means in response to releasing of the trigger to permit rotation of the cylinder to a next position at which a next one of the releasing means is aligned with the actuating means, whereby the stretched rubber bands can be fired as fast as the trigger can be pulled and released.

2. The toy gun of claim 1 including a plurality of elongated radial slots disposed in a rear portion of the cylinder parallel to the axis, and further including a plurality of single flat members each including a corresponding one of the retaining means, releasing means, and rotation limiting means and a pivot pin pivotally connecting that flat member in a corresponding one of the radial slots.

3. The toy gun of claim 2 wherein each of the retaining means includes a rear hook disposed at a forward end of one of the flat members and each of the rotation limiting means includes a rotation limiting tab disposed at a rear end of a corresponding flat member, each pivot pin being disposed between the rear hook and rotation limiting tab of a corresponding flat member.

4. The toy gun of claim 3 including resilient means for urging the rear hook at the forward end of each flat member to recede into a corresponding radial slot when that rear hook is not retaining a rear end of one of the stretched rubber bands.

5. The toy gun of claim 4 wherein pulling of the trigger causes the actuating means to move forward and engage a flat member aligned with the actuating means, forcing the rear hook of that flat member to recede into the corresponding slot, edges of the slot causing the rear hook of that flat member to be withdrawn from the rear end of a corresponding rubber band, thereby releasing that rubber band.

6. The toy gun of claim 5 wherein each of the rotation limiting tabs clears the actuating means during rotation of the cylinder if the rear hook of the corresponding flat member is receded into the slot, and engages the actuating means and prevents further rotation of the cylinder if the rear hook of that corresponding flat member extends outwardly of the corresponding slot.

7. The toy gun of claim 6 wherein the continuous urging means includes an elastic band attached at one end to the cylinder and attached at another end to a frame supporting the cylinder, so that the elastic band can be tensioned as the cylinder is rotated to load the stretched rubber bands by hooking their front and rear ends around corresponding front hooks and rear hooks, respectively.

8. A toy gun for repetitively shooting elastic bands, comprising in combination:

(a) a support frame including a handle and first and second support posts;

(b) a rotary cylinder journalled between the first and second support posts and rotatable about an axis, and a plurality of front hooks attached to a forward portion of the rotary cylinder;

(c) a plurality of pivotal hook/stop elements each including a rear hook, a stop surface, an actuation surface generally perpendicular to the stop surface, and means disposed between the rear hook and the stop surface for pivotally connecting the hook/-stop elements to a rear portion of the rotary cylinder;

(d) a firing/stop mechanism including a first pivotal member connected by a linkage to a trigger, an actuation surface, and a stop surface generally perpendicular to the actuation surface, the firing/stop mechanism moving its actuation surface and stop surface to a forward position when the trigger is actuated and withdrawing its actuation surface and stop surface to a rearward location when the trigger is released;

(e) means for urging the rear hooks of the pivot hook/stop elements inward toward the axis after the elastic bands are propelled, the elastic bands, when stretched between forward hooks of the pivotal hook/stop elements and corresponding front hooks of the rotary cylinder, overcoming the urging means by pivoting the pivotal hook/stop elements to move their forward hooks outward from the axis and to also position the stop surfaces of the pivotal hook/stop elements in alignment with the stop surface of the firing/stop mechanism when it is in its rearward position, the stop surface of the firing/stop mechanism abutting the stop surface of one of the pivotal hook/-stop elements to prevent rotation of the rotary cylinder when an elastic band is stretched between the rear hook of that pivotal hook/stop element and a corresponding front hook, actuation of the trigger causing the actuation surface of the firing/-stop mechanism to abut the actuation surface of that pivotal hook/stop element, urging it forward, forcing the rear hook of that hook/stop element inward toward the axis, and causing that rear hook to release the elastic band, releasing of the trigger causing the firing/stop mechanism to move to the rearward position and disengage the stop surface of the pivotal hook/stop element; elastic means automatically rotating the rotary cylinder upon release of the trigger until the stop surface of a next one of the pivotal hook/stop elements abuts the stop surface of the firing/stop mechanism.

9. A method of operating a toy gun to shoot a plurality of stretched rubber bands, comprising the steps of:

(a) loading a plurality of rubber bands on a rotary cylinder by stretching each rubber band into an elongated configuration with a front end looped around a front hook attached to the rotary cylinder and looping a rear end of that rubber band around a rear hook pivotally attached to a rear portion of the rotary cylinder, and rotating the cylinder to tighten an elastic element having one portion attached to the cylinder and another portion attached to a frame supporting the cylinder as each rubber band is loaded;

(b) preventing rotation of the cylinder in response to the elastic element by engagement of a rotation limiting stop connected to a first one of the rear hooks with an actuator/stop element;

(c) pulling a trigger;

(d) moving the actuator/stop element in response to pulling of the trigger to pivot the first rear hook and the rotation limiting stop connected to the first rear hook from a first position to a second position in response to the pulling of the trigger in order to release a corresponding one of the stretched rubber bands, thereby firing that rubber band;

(e) retaining the first front hook in its second position;

(f) releasing the trigger; and (g) withdrawing the actuator/stop element from the first rotation limiting stop, thereby allowing the elastic element to rotate the cylinder until a second rotation limiting stop connected to a second one of the rear hooks engages the actuator/stop element.

* * * * *